United States Patent [19]

Hatakeyama et al.

[11] Patent Number: 4,801,109

[45] Date of Patent: Jan. 31, 1989

[54] ROLL CORE HOLDING DEVICE

[75] Inventors: Tetsuo Hatakeyama, Tama; Yoshinori Uera, Matsudo; Nobuaki Nagao, Kawasaki, all of Japan

[73] Assignee: Kabushikigaisha Tokyo Kikai Seisakusho, Tokyo, Japan

[21] Appl. No.: 106,033

[22] Filed: Oct. 8, 1987

Related U.S. Application Data

[62] Division of Ser. No. 899,995, Aug. 22, 1986, Pat. No. 4,715,553.

[30] Foreign Application Priority Data

Sep. 2, 1985 [JP] Japan ..... 60-134164

[51] Int. Cl.[4] ..... B65H 75/24

[52] U.S. Cl. ..... 242/72.1

[58] Field of Search ..... 242/72.1, 72 R, 68.4, 242/46.4, 68.2, 68.3, 56.9; 279/2 R, 2 A; 269/48.1

[56] References Cited

U.S. PATENT DOCUMENTS

| | | | |
|---|---|---|---|
| 3,552,673 | 1/1971 | Evers | 242/72.1 |
| 3,868,067 | 2/1975 | Cadillon | 242/72.1 X |
| 4,148,844 | 4/1979 | Hehner | 242/72.1 X |
| 4,149,682 | 4/1979 | Gustafson et al. | 242/72.1 |
| 4,284,251 | 8/1981 | Castillo | 242/72.1 X |
| 4,285,528 | 8/1981 | Neamtu | 242/72.1 X |
| 4,469,288 | 9/1984 | Pontes | 242/72.1 |
| 4,694,559 | 9/1987 | Lundy et al. | 242/72.1 X |

FOREIGN PATENT DOCUMENTS

| | | |
|---|---|---|
| 47-29900 | 9/1972 | Japan . |
| 51-18842 | 6/1976 | Japan . |

*Primary Examiner*—David Werner

*Attorney, Agent, or Firm*—Foley & Lardner, Schwartz, Jeffery, Schwaab, Mack, Blumenthal & Evans

[57] ABSTRACT

The present invention relates to a roll core holding device equipped with a roll core release mechanism which can facilitate to automatically and certainly release the empty roll core from a rotary printing machine. The roll core holding device for each end of a roll core comprises a shifting means; a center member capable of shifting owing to the shifting motion of the shifting means and consisting of a base section and a shaft section protruded from the base section; a plurality of pawls capable of shifting along the shaft section of the center member, arranged so as to widen the space between the pawls as they are shifted toward the base section; an urging means for the pawls toward the top of the shaft section; and a stopper secured at the top of the shaft section of the center member.

2 Claims, 6 Drawing Sheets

ROLL CORE HOLDING DEVICE

BACKGROUND OF THE INVENTION

This application is a division, of application Ser. No. 899,995, filed Aug. 22, 1986, now U.S. Pat. No. 4,715,553.

1. Field of the Invention

The present invention generally relates to a roll core holding device for a rolled thin plate shape article. More particularly, the present invention relates to a roll core holding device equipped with a roll core release mechanism which automatically and reliably release the empty roll core; i.e., a rolled article that has been wholly used, from a rotary printing machine.

2. Description of the Prior Art

Conventional roll core holding devices have been disclosed in Japanese Patent Publication No. 51-18842 entitled "Automatic Paper Roll Changing Device in a Rotary Printing Device" (hereinafter "Automatic") and Japanese Patent Publication for Utility Model No. 47-29900 entitled "Unwinding Drum" (hereinafter "Unwinding").

A paper roll holding section, disclosed in "Automatic" is shown in FIG. 9. A paper roll 331 is held by means of a center collar 332 having a taper which is forcibly engaged within a core of the paper roll.

FIG. 10 is sectional view showing one example of mandril type unwinding drum for a strip coil as disclosed in "Unwinding". This unwinding drum comprises a drum segment 441 provided with a protruding member 443 and n side guide 442 formed with a groove. This protruding member 443 is so arranged as to coincide with the same surface level of the side guide 442. The groove of the side guide 442 is defined by assembling the protruding member 443 with the side guide 442. The drum segment 441 and the protruding member 443 are forcibly opened or moved in the radius direction as a wedge shaped member 444 is moved forward.

In a printing process using a rotary printing machine, a printing web fed from a paper roll is subjected to a predetermined tension caused by restraining force applied to the paper roll. This restraining force is typically generated by forcibly pressing belt on the external surface of this paper roll. Since this procedure may often injure the paper surface, a shaft for holding the paper roll applied with the restraining force has recently been preposed. This new procedure requires fixing the paper roll with the holding member firmly so as to preventing the engaged members from loosening.

The arrangement shown in FIG. 9 requires a relatively large force to press the tapered center collar in order to prevent the engaged section from slipping under the influence of the restraining force. Although the arrangement shown in FIG. 10 can provide a firm engagement, a new problem may occur when the empty core of paper roll is disengaged from the roll holding member. The spring force and the weight of the empty core are too small to disengage the holding member from the core, so that this may sometimes cause the empty core to interfere with the printing device.

SUMMARY OF THE INVENTION

It is an object of the present invention to provide a roll core holding device which can automatically and reliably release the empty core of paper roll from its engaged place.

Another object of the present invention is to provide a roll core holding device which can reliably hold the core of paper roll in its regular position even when pressing force to retain the paper roll is decreased or lost.

To accomplish the above objects, the roll core holding device for each end of a roll core according to one embodiment of the present invention comprises a shifting means; a center member capable of shifting owing to the shifting motion of the shifting means and consisting of a base section and a shaft section protruded from the base section; a plurality of pawls capable of shifting along the shaft section of the center member, arranged so as to widen the space between the pawls as they are shifted toward the base section; an urging means for urging the pawls toward the top of the shaft section; and a stopper secured at the top of the shaft section of the center member.

According to a second embodiment of the present invention, the roll core holding device for each end of a roll core comprises a shifting means; a center member capable of shifting in response to the shifting means and comprising of a base section, a shaft section protruding from the base section and a plurality of grooves formed in the shaft section from its top to base; a plurality of pawls slidably engaged within the grooves of the center member so that the space between the pawls become wide as the pawls slide toward the base section of the center member whereby the pawls become completely embedded in the grooves as they slide toward the top of the shaft section; an external member slidably mounted on the shaft section of the center member, and comprising a cylidrical section and a flange section, the cylindrical section formed with a plurality of openings through which the head portion of the pawls can appear; a retaining member which contacts the end of roll core in order to retain the core; a pressing means which is penetratingly arranged through the flange section of the external member from the base section of the center member so as to support the retaining member for pressing the flange section toward the top of the center member from the base section thereof; an urging means for urging the pressing means toward a top side thereof; and a stopper secured to the top of the shaft section of the center member.

Further objects of this invention will become obvious upon an understanding of the illustrative embodiments described shortly or in the appended claims, and various advantages not referred to herein will occur to one skilled in the art upon employment of the invention in practice.

DETAILED DESCRIPTION OF THE PREFERRED EMBODIMENT

Figure 1:
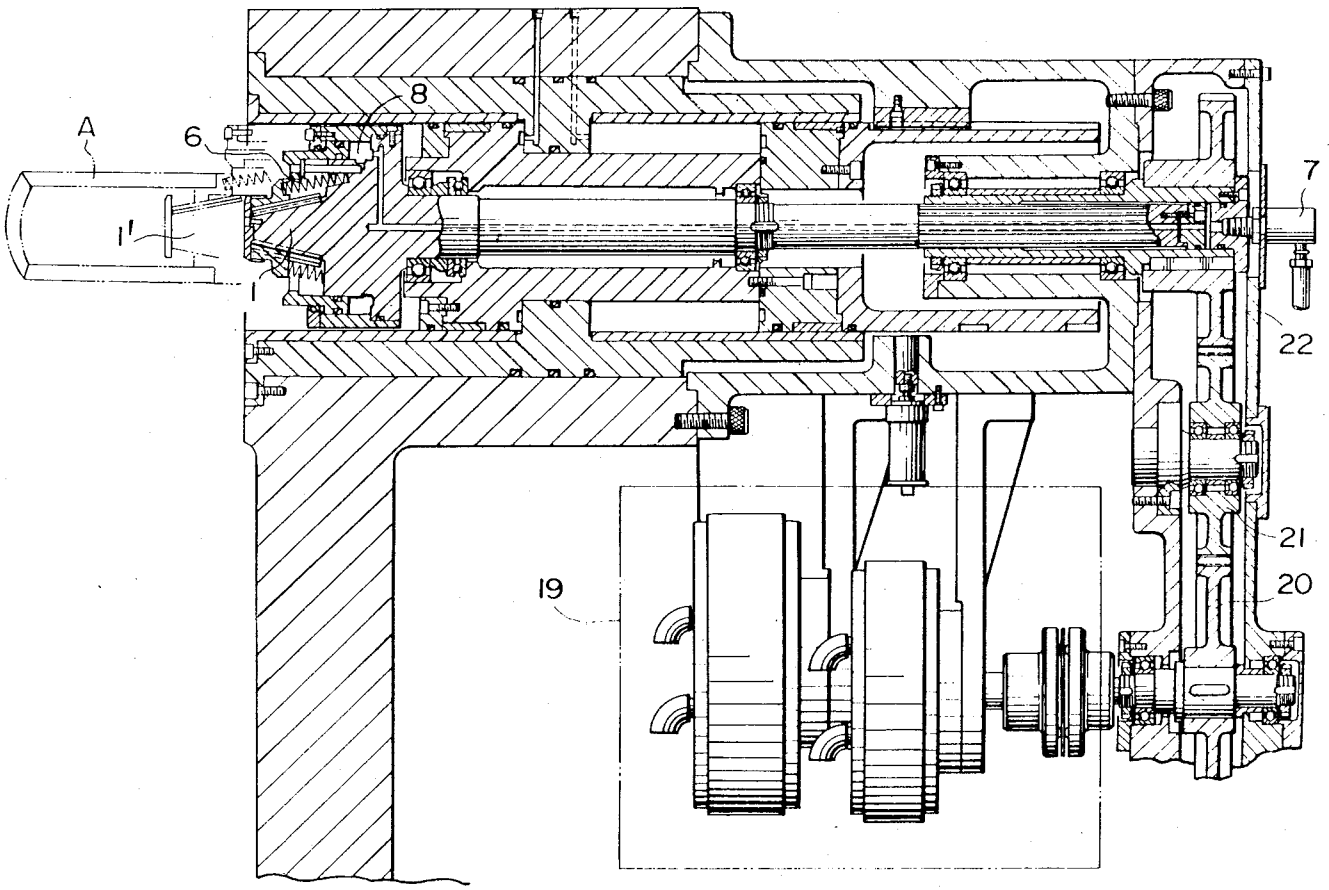
FIG. 1 is a schematic perspective side view showing a first embodiment of the roll core holding device according to the present invention.

Referring to FIG. 1, there is shown a first embodiment of a roll core holding device which is applied to a spider arm (three roll reel). The reference numeral 1 denotes a center member consisting of a base section and a shaft section protruded from the base section. The forward portion of the shaft section is formed in a tapered conical shape.

Figure 2:
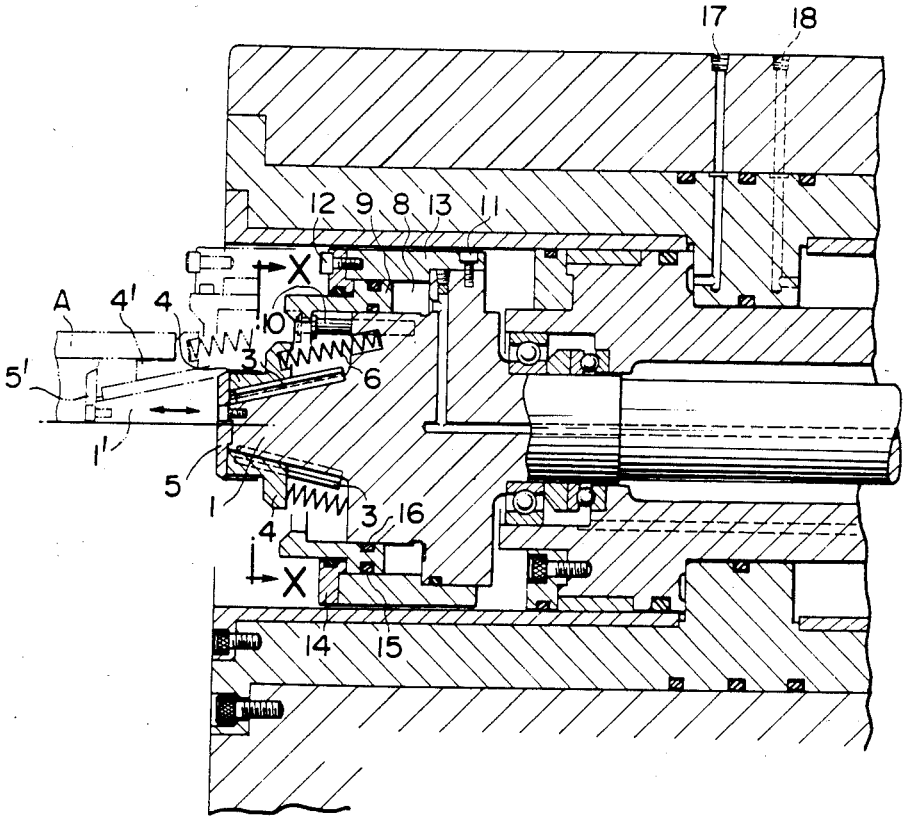
FIG. 2 is an enlarged perspective side view showing an essential portion of FIG. 1.
Figure 3:
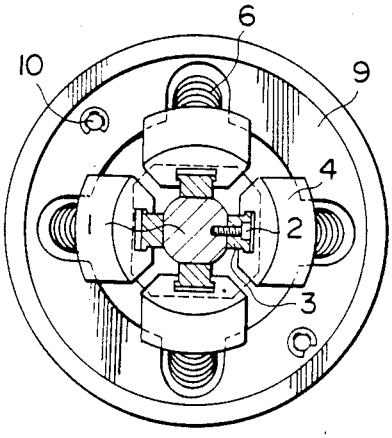
FIG. 3 is a sectional view taken along the line X—X in FIG. 2.
Figure 4:
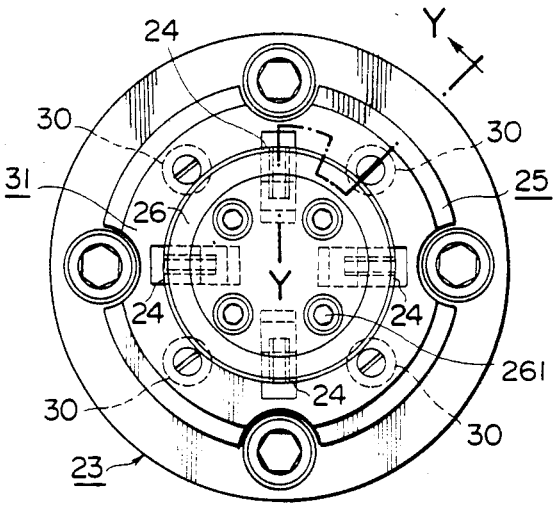
FIG. 4 is a schematic elevation view showing a second embodiment of the roll core holding device according to the present invention.

This center member 1 is shown in FIG. 2 in detail. This is an enlarged view of FIG. 1 and FIG. 3 is a sectional view taken along the line X—X of FIG. 2. A plurality of pawl guides 3 are fixed to the outer surface of the conical shaft section of the center member 1 by screws 2. Although four pawl guides 3 are shown in this embodiment, the number of pawl guides 3 is not limited. On account of the holding force and balance with a roll core A, the number of pawl guides 3 is preferably three or more. The reference numeral 4 denotes a pawl formed in a step shape of the base side step (right side in FIG. 2) of which is larger than the top side step. The pawls 4 are respectively engaged within the pawl guides 3 and can be slid along them.

The reference numeral 6 denotes an urging member such as a spring. This spring 6 is arranged between the conical shaft section of the center member 1 near the base section and the pawl 4 so that the pawl 4 is urged toward the top of the conical shaft section. In this embodiment, the external diameter of the top side of the pawls 4 is smaller than the internal diameter of the roll core A represented by a phantom line in FIG. 2.

The reference numeral 5 denotes a stopper which is fixed to the top end of the center member 1 so as to limit the movement of the pawls 4 towards the top of the center member 1 in response to the urging force of the spring 6.

The reference numeral 7 denotes a rotary joint and the numeral 8 denotes a pneumatic chamber. They are connected through a conduit through which compressed air is fed to the pneumatic chamber 8 from a pneumatic pump, not shown, via the rotary joint 7. This compressed air is used for shifting the center member 1. In this embodiment, the center member 1 is moved backwards (rightward in FIG. 2); i.e., the roll core A releasing motion, when the compressed air is fed into the pneumatic chamber 8.

The reference numeral 9 denotes a pawl pressing member. The bottom of the pawl pressing member 9 is applied with the air pressure from the pneumatic chamber 8 and its top can engage the pawl 4 near by the spring 6.

The reference numeral 10 denotes a guide pin for preventing revolution and slanting and for securing regular actuation of the pawl pressing member 9.

The reference numerals 13 and 14 denote external a cylindrical case and lid, respectively. They are fixed to the center member 1 through screws 11 and 12 so that together with the center member 1, they constitute an air cylinder.

The reference numerals 15 and 16 denote O-rings. The reference numerals 17 and 18 denote first and second air conduits which are communicated with the pneumatic pump, (not shown).

With further reference to FIG. 1, the reference numeral 19 denotes a braking device, and the reference numerals 20, 21 and 22 denote gears for transmitting braking torque.

Operation of this first embodiment is as follows. In order to mount the roll core A on the holding device, the compressed air is supplied to the first air conduit 17 from the pneumatic pump, so that the center member 1 is moved towards the roll core A. The external side surfaces of the pawls 4 contact the internal surface of the roll core A. The pawls 4 are forcibly moved towards the base section of the center member 1 under the compression of the spring 6. The distance between the adjacent pawls 4 are gradually increased as the pawls 4 are moved towards the base section of the center member 1 since the pawl guides 3 are fixed on the surface of the conical shaft section. The pawls 4 forcibly press the internal surface of the roll core A due to the wedge action, so that the roll core A is fixed to the center member as shifted towards the roll core A (represented by a phantom line 1').

When the paper roll has been completely consumed and thus the roll core is empty, the empty roll core should be removed from this holding device. The compressed air is supplied to the second air conduit 18. The center member 1 is forcibly moved backwards and returned to its initial position, so that the roll core A is released from the center member 1. The compressed air is also introduced into the pneumatic chamber 8 through the rotary joint 7 in synchronism with the supply of air into the second air conduit 18. The pawl pressing member 9 is moved towards the roll core A as the center member 1 is shifted, and thus the pawl pressing member 9 presses the pawls 4 to make the engagement bewteen the roll core A and the pawls 4 loose. The loosed pawls 4 are slid along the pawl guides 3 in response to the urging force of the spring 6. As a result, the roll core A is reliably released from the center member 1.

In this embodiment, the shifting operation of the center member 1 and the pawl pressing members 9 are actuated by the compressed air. This compressed air can be replaced with other actuating means such as fluid pressure means for example hydraulic pressure, electric means, magnetic means, or mechanical means. This pawl member 9 may be moved in by a slow motion or by a hammering, pressing motion.

According to this operation, the empty roll core A can be completely and reliably released form the holding device.

Referring to FIG. 4 to FIG. 8, a second embodiment of the holding device according to the present invention will be explained.

Figure 5:
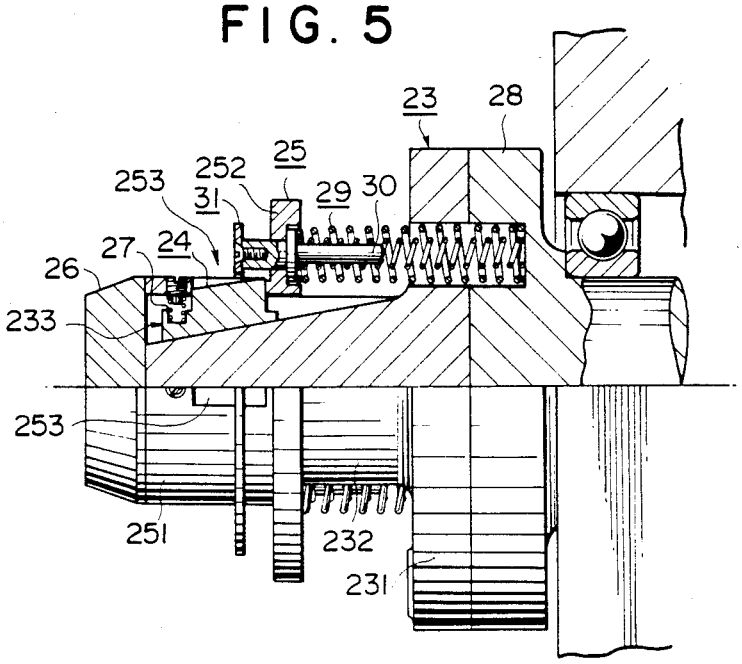
FIG. 5 is a sectional view taken along the line V—V in FIG. 4.

A center member 23 fixed to a shaft front plate 28 is composed of a base section 231 and a shaft section 232 protrudes from this base section 231 as shown in FIG. 5 wherein a partical sectional view is illustrated. The shaft section 232 is formed with a plurality (four) of slant grooves 233 whose depth increases from the base side to the top side. In each slant groove 233 a pawl 24 is slidably engaged.

An external member 25 is slidably mounted on the shaft section 232 of the center member 23 so as to cover the pawls 24. This external member 25 is composed of a cylindrical section 251 and a flange section 252.

A stopper 26 is threadingly secured to the top of the shaft section 232 through screws 261 to prevent the members assembled from disengaging from the center member 23.

The cylindrical section 251 of the external member 25 is formed with a plurality (four) of through holes 253 passing through between the inferior and exterior of the cylindrical section 251. The head of each pawl 24 is engaged within each through hole 253. Four springs 27 are so arranged that each pawl 24 is always in in contact with the bottom of the slant groove 133.

Four pressing members 30 are arranged behind the flange section 252 of the external member 25 and urged by four sets of urging means 29. The urging means 29 are supported by the shaft front plate 28 so that the flange section 252 of the external member 25 is subjected to the urging force from the urging means 29. A contact member 31 having an annular shape is fixed to the pressing members 30 through four connecting members which are passed through the flange section 252 of the external member 25 and protrude from the pressing end of the pressing members 30.

Although this second embodiment has four sets of the pawl 24 and the pressing member 30, this number is not limited to four if the center member 23 can be firmly fit to the roll core with suitable balance. Furthermore, the urging means 29 is not limited to only the coil spring, but other means such as a pneumatic spring can be also used if such means provide similar effect.

Figure 8:
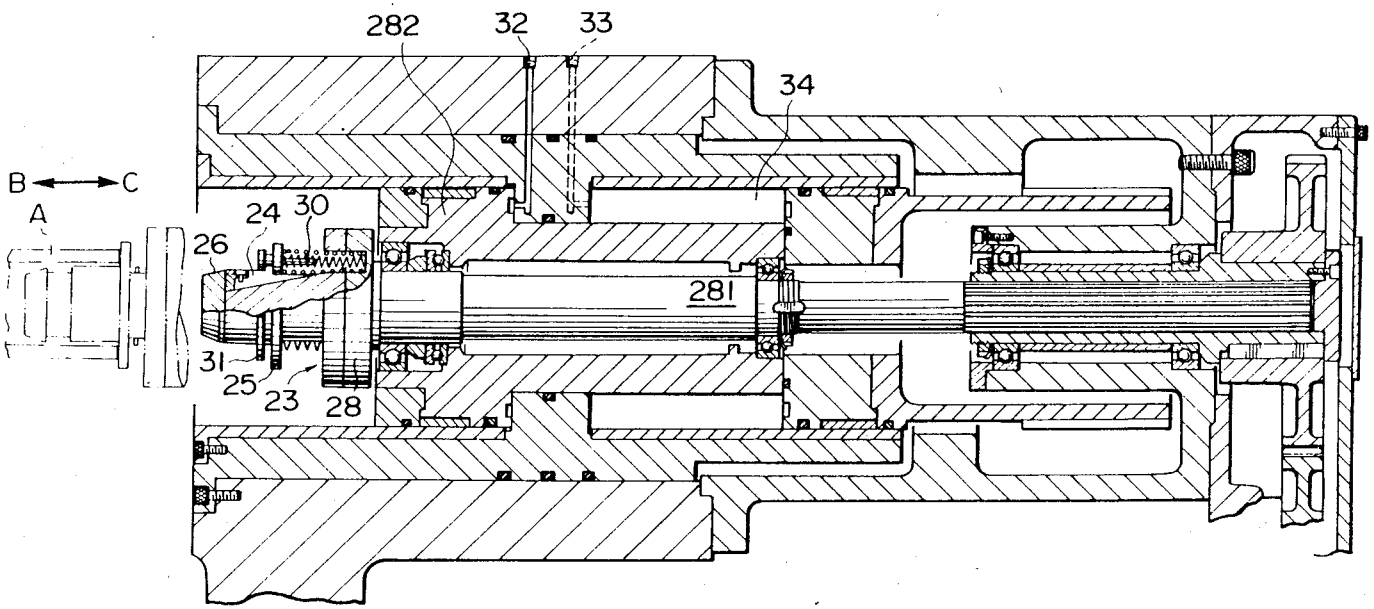
FIG. 8 is a schematic perspective side view of the second embodiment.
Figure 9:
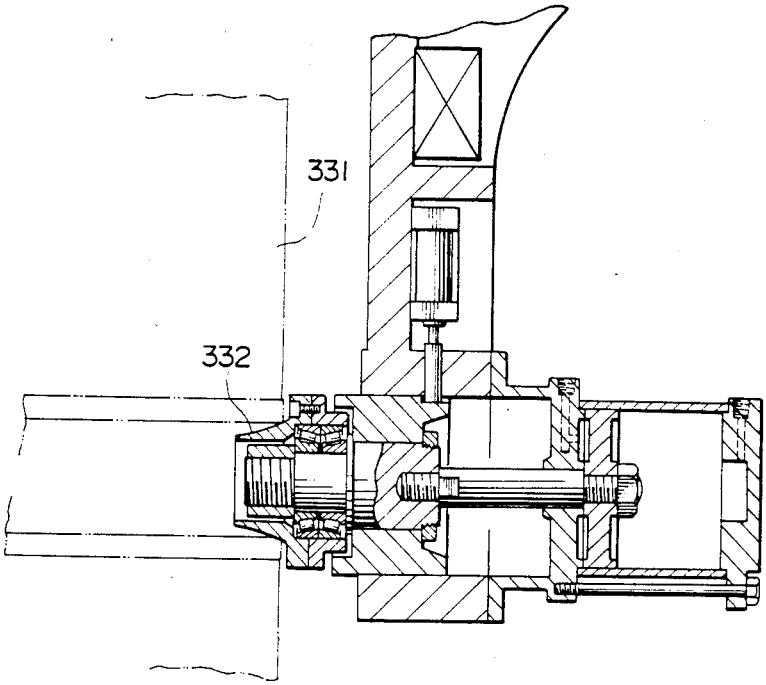
FIG. 9 PRIOR ART
FIG. 9 is a sectional view showing a first prior art roll core holding device.
Figure 10:
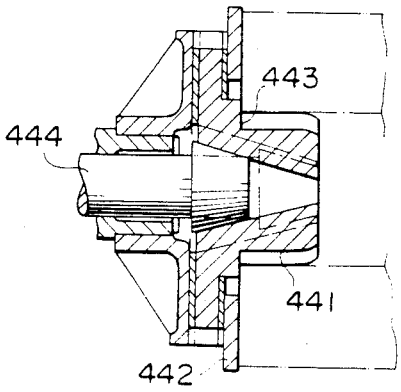
FIG. 10 PRIOR ART
FIG. 10 is an enlarged sectional view showing a second prior art roll core holding device.

Referring to FIG. 8, first and second air conduits 32 and 33 and a pneumatic chamber 34 are similarly constituted as in the first embodiment.

Operation of this second embodiment is as follows.

Figure 6:
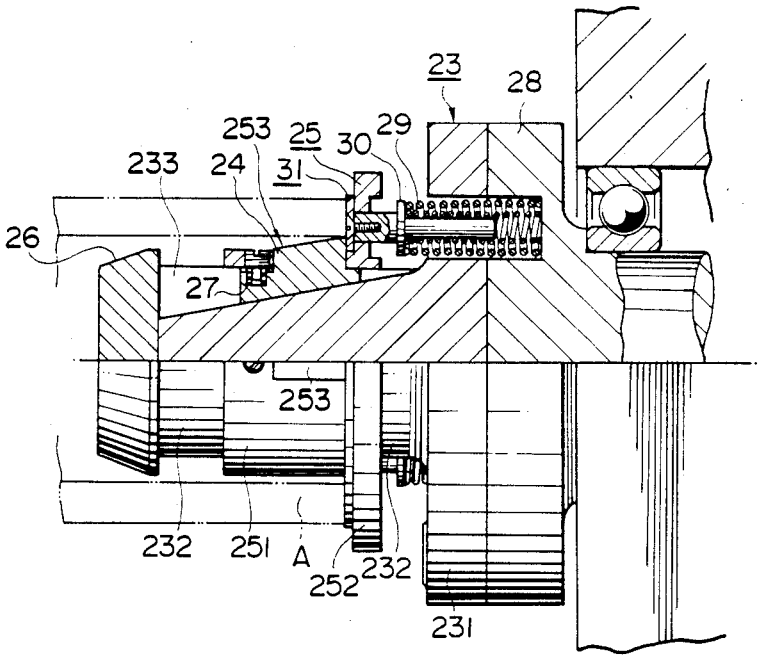
FIG. 6 is a sectional view similar to FIG. 5, showing that a roll core is held by this holding device.

In order to mount a roll core A on the holding device set on a spider arm (three roll reel), compressed air is fed into the first air conduit 32 from a pneumatic pump to a shifting means (not shown) via a switching valve (not shown) and the air is simultaneously discharged from the pneumatic chamber 34 through the second air conduit 33, so that the compressed air makes shaft 281 shift forward (leftward as represented by the arrow B in FIG. 8) together with a shaft supporting member 282. In response to this motion, the shaft front plate 28 and the center member 23 fixed on the plate 28 are also shifted forward as represented by the phantom line in FIG. 8. The external member 25, the stopper 26 and the spring 27 are shifted towards the roll core A. The elements such as the stopper 26 and the cylindrical section 251 of the external member 25, having smaller diameters than the internal diameter of the roll core A, are placed in the core A. Then, the annular contact member 31 contacts the side end of the roll core A and is moved backwards along the shaft section 232 of the center member 23 under compression by the urging means 29 transmitted through the pressing member 30. The contact member 31 contacts to the flange section 252 of the external member 25 and further moves backward together with the external member 25. As the external member 25 moves backward, the pawls 24 are also moved backward within the slant grooves 233 formed in the center member 23. The pawls 24 are forcibly moved upwards due to the slanted bottom of the grooves 233, so that the head section of the pawls 24 are projected out of the through holes 253 formed in the external member 25. The pawls 24 firmly fit on the internal wall of the roll core A as shown in FIG. 6. At this point, the roll core A is firmly held by the holding device.

When the paper roll has been completely consumed and the roll core is empty, the empty roll core should be removed from this holding device. The compressed air is fed into the second air conduit 33 from the pneumatic pump (not shown) by switching the switching valve (not shown) and the previously fed air is discharged from the first air conduit 32. The shaft 281 with the shaft supporting member 282 is forcibly moved in the direction shown by the arrow C in FIG. 8 in response to the pneumatic pressure and thus the holding members are retracted from the roll core A to the position represented by the solid line. Then, the urging means 29 applies a returning force to the contact member 31 through the pressing member 30. The contact member 31 is moved along the shaft section 232 of the center member 23. Although the contact member 31 keeps in contact with the side end of the roll core A, the other holding members such as the center member 23, the external member 25 and the pawls 24, are retracted from the roll core A. The top of the pressing member 30 presses again the flange section 252 of the external member 25 which had been previously retracted. As the external member 25 is moved forwards, the pawls 24 are moved within the slant grooves 233 formed in the shaft section 232 of the center member 23. Since the pawls 24 are urged to the bottom of the grooves 233 by the spring 27, the pawls 24 are gradually moved downwards as they move. Thus the head of the pawls 24 have been completely sunk in the through holes 253 formed in the cylindrical section 251 of the external member 25. This external member 25 is forcibly contacted to the stopper 26 fixed to the top of the shaft section 232 of the center member 23, so that the external member 25 stops. After this motion, the shaft front plate 28 and its assembled members such as the center member 23, the spring 27, and so on are further returned to their initial position and thus the roll core A can be completely released.

Even if the pressure of the compressed air fed in the air conduit 32 is accidently reduced or lost during holding the roll core, the center member 23 can be slightly backed and quickly stopped. The roll core will be held by the combination of the center member 23 and the external member 25. The bottom of the slant groove 233 is subjected to a force created by the weight of roll core through the pawls 24 so that the center member 23 is forcibly moved backward. The center member 23 is subjected to this force only until the pawls 24 sink in the through holes 253 formed in the external member 25. Therefore, the roll core can be held even if any difficulties arise.

Figure 7:
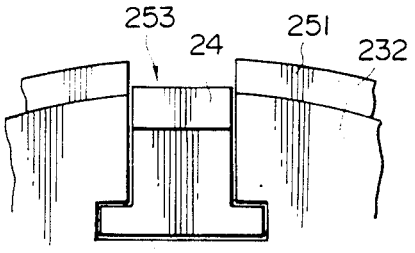
FIG. 7 is an elevation showing a modification of FIG. 4.

In this second embodiment, although the springs 27 are used as the urging means for constantly urging always the pawls 24 towards the groove bottom so as to sink the pawls 24 within the slant grooves 233, this may be replaced with a modified constitution. For example, the configurations of the groove bottom and the pawls 24 can be formed as shown in FIG. 7 wherein the base of the pawl 24 is slidably engaged with the recess formed in the bottom of the slant groove 233. This engagement can provide the same function of the second embodiment without an urging means such as the spring 27.

Furthermore, the slant groove 233 of the center member 23 may contain a flat bottom groove in which a slant plate is additionally fit so as to provide essentially same effect of the slant groove 233.

As explained above, the holding and releasing mechanism provided by the present invention can reliably hold the roll core even when the actuating means may be subjected to any troubles such as if the fluid pressure for the actuating means suddenly decreases or leaks, and the mechanism will reliably release the empty roll core when the paper roll has been completely consumed.

Although the invention has been described in its preferred from with a certain degree of particularlity, it is understood that the present disclosure of the preferred form may be changed in the details of construction and the combination and arrangmement of parts may be resorted to without departing from the spirit and the scope of the invention as hereinafter claimed.

What is claimed is:

1. A roll core holding device for each end of a roll core comprising, a shifting means;

a center member capable of shifting owing to the shifting motion of the shifting means and comprising a base section and a shaft section protruding from the base section;

a plurality of pawls capable of shifting along the shaft section of the center member, arranged so as to widen the space between the adjacent pawls as the pawls are shifted toward the base section;

means for urging the pawls toward the top of the shaft section;

means for pressing the pawls toward the roll core as said center member is shifted;

means for actuating the pawl pressing means;

a stopper secured at the top of the shaft section of the center member; and wherein the shaft section of the center member is a conical shape tapered to its top.

2. The roll core holding device as set forth in claim 1, wherein urging means is a spring.

* * * * *